US008139994B2

(12) United States Patent
Suzuki

(10) Patent No.: US 8,139,994 B2
(45) **Date of Patent: *Mar. 20, 2012**

(54) AUTOMATIC ORIGINAL COVER CLOSER AND OFFICE EQUIPMENT HAVING THE SAME

(75) Inventor: Naokazu Suzuki, Kanagawa (JP)

(73) Assignee: Katoh Electrical Machinery Co., Ltd, Kanagawa (JP)

( * ) Notice: Subject to any disclaimer, the term of this patent is extended or adjusted under 35 U.S.C. 154(b) by 834 days.

This patent is subject to a terminal disclaimer.

(21) Appl. No.: 12/183,708

(22) Filed: Jul. 31, 2008

(65) Prior Publication Data

US 2009/0034208 A1 Feb. 5, 2009

(30) Foreign Application Priority Data

Aug. 1, 2007 (JP) ..... 2007-201183

(51) Int. Cl.
*G03G 15/00* (2006.01)

(52) U.S. Cl. ..... 399/380; 16/221; 16/239; 16/354; 49/333; 49/334; 49/335; 297/362.11

(58) Field of Classification Search ..... 399/380; 16/221, 239, 354; 297/362.11; 49/333, 334, 49/335

See application file for complete search history.

(56) References Cited

U.S. PATENT DOCUMENTS 6,386,476 B1 * 5/2002 Adleman, Jr. ..... 242/532.5
7,512,376 B2 * 3/2009 Suzuki ..... 399/380
2006/0180972 A1 * 8/2006 Suzuki ..... 271/3.14

* cited by examiner

*Primary Examiner* — Judy Nguyen
*Assistant Examiner* — Andy Pham
(74) *Attorney, Agent, or Firm* — Notaro, Michalos & Zaccaria P.C.

(57) ABSTRACT

In order to reduce a number of parts and required costs, and to improve operability during assembly and maintenance, the automatic original cover closer comprises hinge portions having a supporting member which supports the original cover to be opened and closed with regard to a main body of an office equipment and a driving portion automatically driving the supporting member of the hinge portions. The automatic original cover closer is characterized in that the supporting member is rotatably supported via a rotation shaft on a mounting member attached to the main body, that the driving portion comprises a driving motor and a driving force transmitting mechanism for transmitting a rotation drive force of the driving motor to the rotation shaft, and that the rotation shaft is adjusted so that its rotation drive force can be transmitted to the supporting member via a shaft engaging members fixedly attached thereto.

8 Claims, 14 Drawing Sheets

(a)

(b)

(a)

(b)

AUTOMATIC ORIGINAL COVER CLOSER AND OFFICE EQUIPMENT HAVING THE SAME

BACKGROUND OF THE INVENTION

1. Field of the Invention

The present invention relates to an automatic original cover closer suitable in use for office equipments including a copying machine, a printer, a facsimile, a scanner, and the like. It further relates to an office equipment provided with the mentioned automatic original cover closer.

2. Background Arts

An original cover is rotatably mounted via an original cover closer to an upper surface of a main body of office equipments including a copying machine, a printer, a facsimile, a scanner, and the like. The above-mentioned original cover closer rotatably supports the original cover, so that a contact glass on the upper surface of the main body can be both covered with the original cover and exposed. The original cover is normally closed in a close contact with the contact glass, when the office equipment is not used. It is necessary to expose (open) the contact glass for setting an original on the contact glass without using an automatic original feeder. The original is set on an exposed upper surface of the contact glass, and afterwards the original cover is closed, and the original is press-contacted on the contact glass using the original cover.

As above described, most operations of the original cover are generally made by hands. Its manual operations may be difficult especially for an aged or handicapped person, e.g. the one in a wheelchair. Further the one with his both hands being occupied with a voluminous original may be required to put once the original down somewhere around the office equipment in order to set it on the contact glass. For this reason, an automatic original cover closer automatically rotating the original cover has been proposed. A publicly known document which relates to the device is JP Laid-Open Patent Publication No. 2006-145708.

The automatic original cover closer is provided with hinge portions supporting an original cover so as to be rotatable with regard to a main body of an office equipment, and driving portion(s) automatically driving the hinge portions. The hinge portions have a mounting member mounted to the main body, and a supporting member pivotally supported via a rotation shaft on the mounting member so as to be rotatable together with the rotation shaft. The driving portion has a driving case mounted to the main body, a driving motor mounted to the driving case so as to be rotatable in clockwise and anticlockwise directions, and a driving force transmitting mechanism for transmitting a rotation drive force of the driving motor to a driving shaft at a reduced speed. The driving shaft is coupled with the rotation shaft of the hinge portions, so that the rotation drive force of the driving motor is transmitted via the driving shaft and the rotation shaft, thus realizing an automatic opening and closing of the original cover.

In the automatic original cover closer as described in the above-mentioned Laid-Open Patent Publication, the rotation shaft is mounted to the supporting member by mounting a spacer to a shaft insertion hole which receives the rotation shaft of the supporting member, and further mounting to an outer surface of side plates of the supporting member torque plates having an engagement hole to be engaged with the rotation shaft. As a result, a number of parts is increased, which is one of the factors leading to an increase in costs. Moreover, since the hinge portions are mounted via a mounting member to the main body and the driving portion is mounted via a driving case to the main body, the hinge portions and driving portion should be separately removed from the main body and mounted again, which results in an unsatisfactory operability.

SUMMARY OF THE INVENTION

In order to solve the above-mentioned problems, the present invention has an object to provide an automatic original cover closer which can reduce a number of parts and costs. It has further an object to provide an automatic original cover closer which improves operability during assembly and maintenance.

In order to achieve the above-mentioned object, an automatic original cover closer according to the present invention is equipped with hinge portions having a supporting member for supporting an original cover so as to be opened and closed with regard to a main body of an office equipment, and with a driving portion driving the supporting member of the hinge portions. The automatic original cover closer is further characterized in supporting member is supported on a mounting member attached to the main body, so as to be rotatable via a rotation shaft, that the driving portion comprises a driving motor and a driving force transmitting mechanism for transmitting a rotation drive force of the driving motor to the rotation shaft, and that the rotation shaft is so adjusted that it can transmit its rotation drive force via shaft engaging members fixedly attached to said supporting member.

According to this aspect of the present invention a rotation shaft is so adjusted that it transmits its rotation drive force to a supporting member via shaft engaging members fixedly attached thereto. In this manner a torque plate can be omitted, reducing a number of parts and enabling a simple structure and reduced cost.

Further in an automatic original cover closer according to the present invention, it is preferable that the supporting member has both side plates and is supported by the rotation shaft on both side plates of the mounting member, and wherein the shaft engaging members are attached at least to either one of the side plates of the supporting member. Still further, in the automatic original cover closer according to the present invention, it is preferable that wherein the mounting member is equipped with a bottom plate attached to the main body and with both side plates extending upwards in a perpendicular direction from the side portions of the bottom plate and provided with respective shaft holes, that the supporting member is equipped with a top plate and both side plates extending downwards in a perpendicular direction downwards from the side portions of the top plate and provided with respective shaft fixing holes to be engaged with the rotation shaft, and that the shaft engaging members are a pair of shaft engaging members independently inserted and fixed into the respective shaft fixing holes of both the side plates of the supporting member, and engaging holes are provided on the respective shaft engaging members through which the rotation shaft is inserted without rotating. Still further, in the automatic original cover closer according to the present invention, it is preferable that the shaft engaging member is a shaft enclosing member in a cylindrical shape and the rotation shaft is attached thereto so as to rotate together with the shaft enclosing member. Still further, in the automatic original cover closer according to the present invention, it is preferable that the shaft enclosing member is engaged with both the side plates of the supporting member, so as to rotate together therewith.

Moreover, in the automatic original cover closer according to the present invention, it is preferable that the hinge portions are attached to the main body, and the driving portion is attached via a mounting plate to the hinge portions. According to these aspects of the present invention, either the hinge portions or the driving portion have only to be attached or removed for attaching and removing the other, thus operability during assembly and maintenance is improved.

In addition, an office equipment according to the present invention is also characterized in that it comprises the above-described automatic original cover closer according to the present invention in order to achieve the above-mentioned object. According to this aspect of the present invention, in the same manner as is described above, it can reduce a number of parts used and allow for a simple structure and reduced costs, and further improves operability during assembly and maintenance.

As described above, in an automatic original cover closer according to the present invention a rotation shaft is so adjusted that it transmits its rotation drive force to a supporting member via shaft engaging members fixedly attached thereto. In this manner the automatic original cover closer can reduce a number of parts used, and realize a simple structure and a reduced cost. Furthermore, a coupling of a driving portion via a mounting plate to hinge portions or a coupling of hinge portions via a mounting plate to a driving portion improves operability during assembly and maintenance.

DETAILED DESCRIPTION OF THE PREFERRED EMBODIMENT(S)

Hereinafter an original cover closer according to the present invention will be described in detail with reference to the attached drawings.

Figure 1:
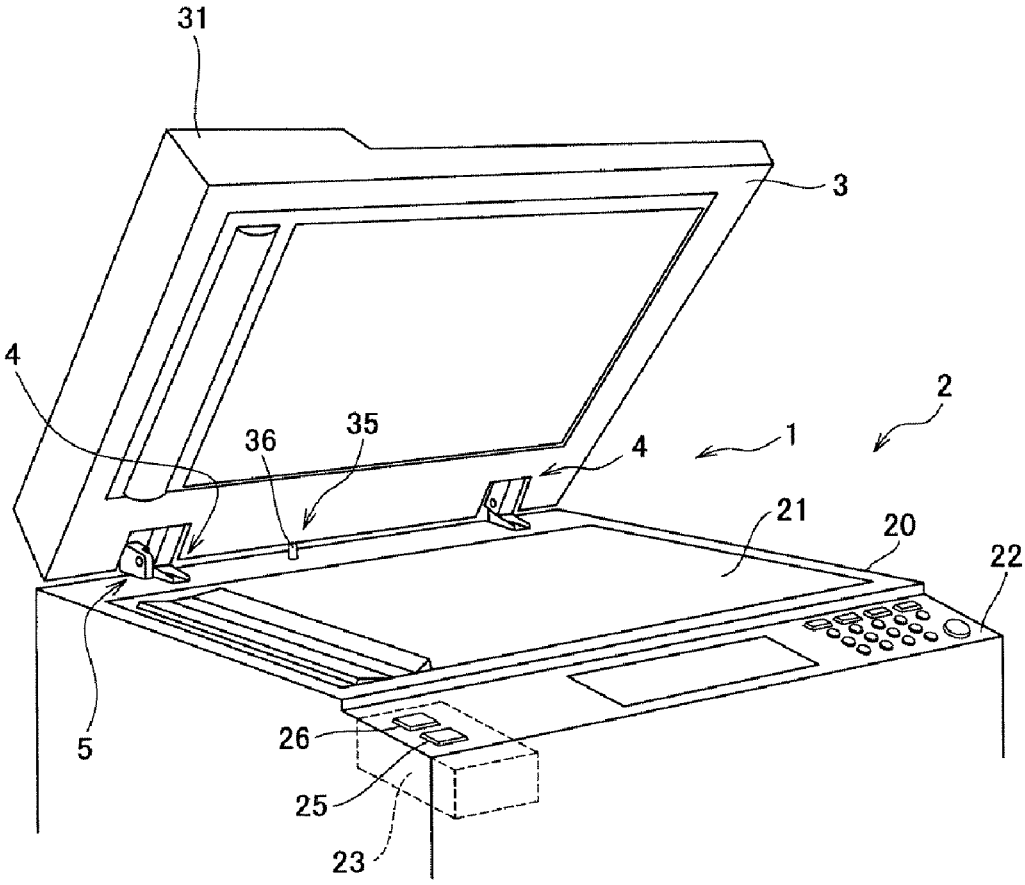
FIG. 1 is a schematic perspective view of an office equipment according to the present invention.
Figure 2:
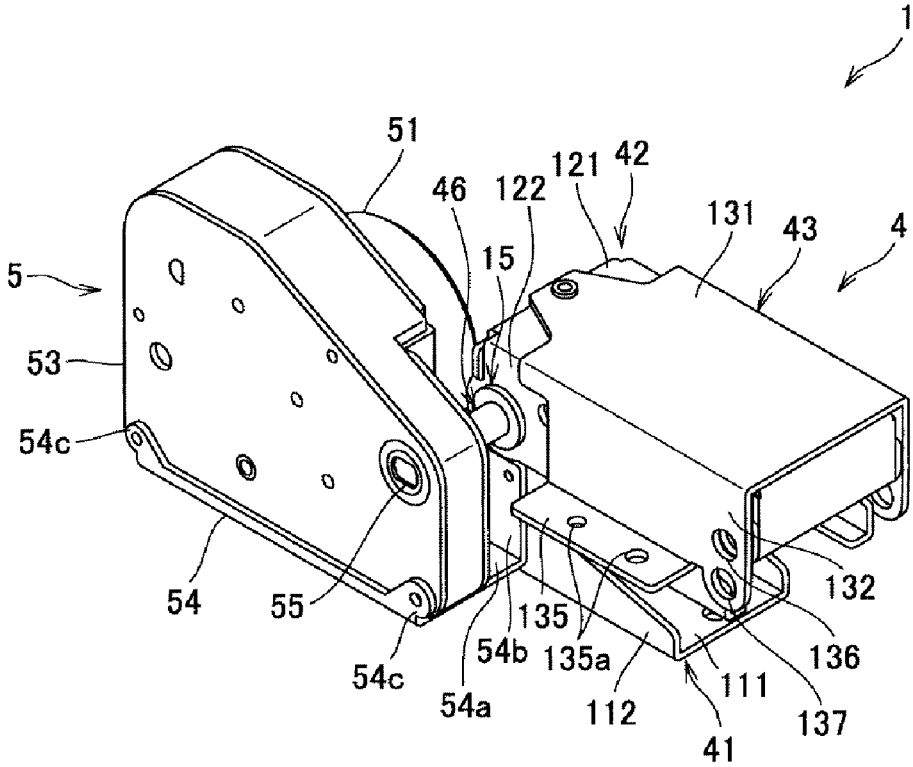
FIG. 2 is a perspective view of an example of a first automatic original cover closer according to the present invention.
Figure 3:
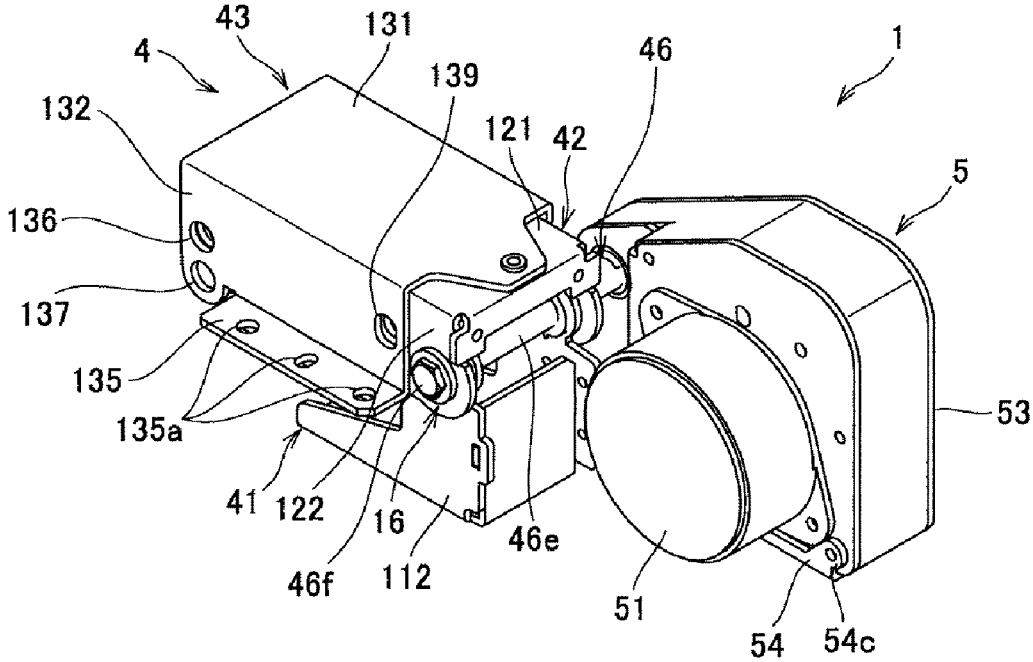
FIG. 3 is an exploded perspective view of an example of a first automatic original cover closer according to the present invention.
Figure 6:
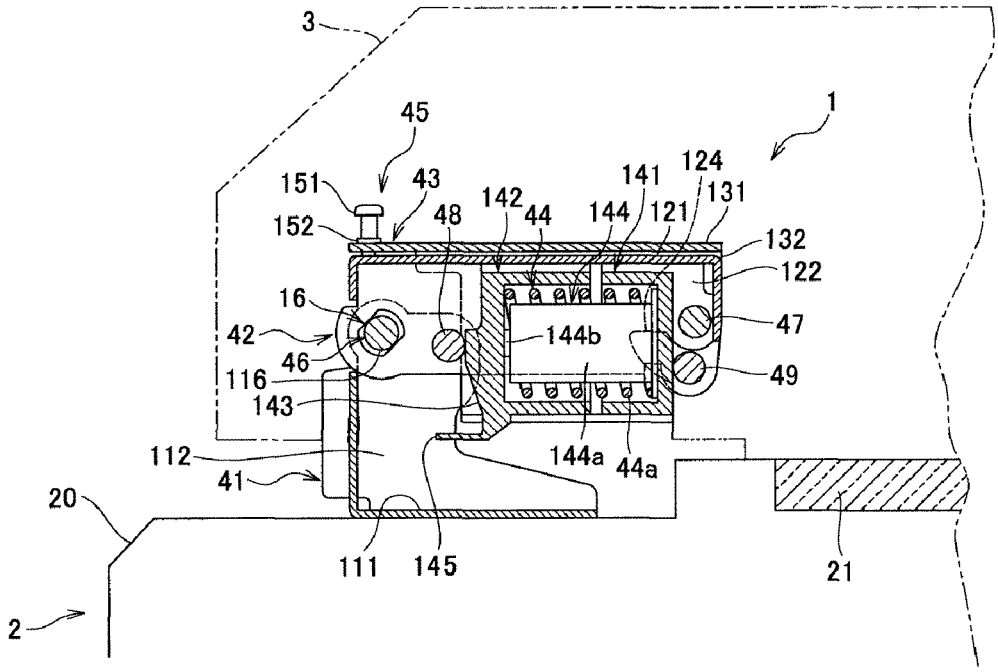
FIG. 6 is a sectional side view of an example of a first automatic original cover closer according to the present invention, specifically in a closed state.
Figure 7:
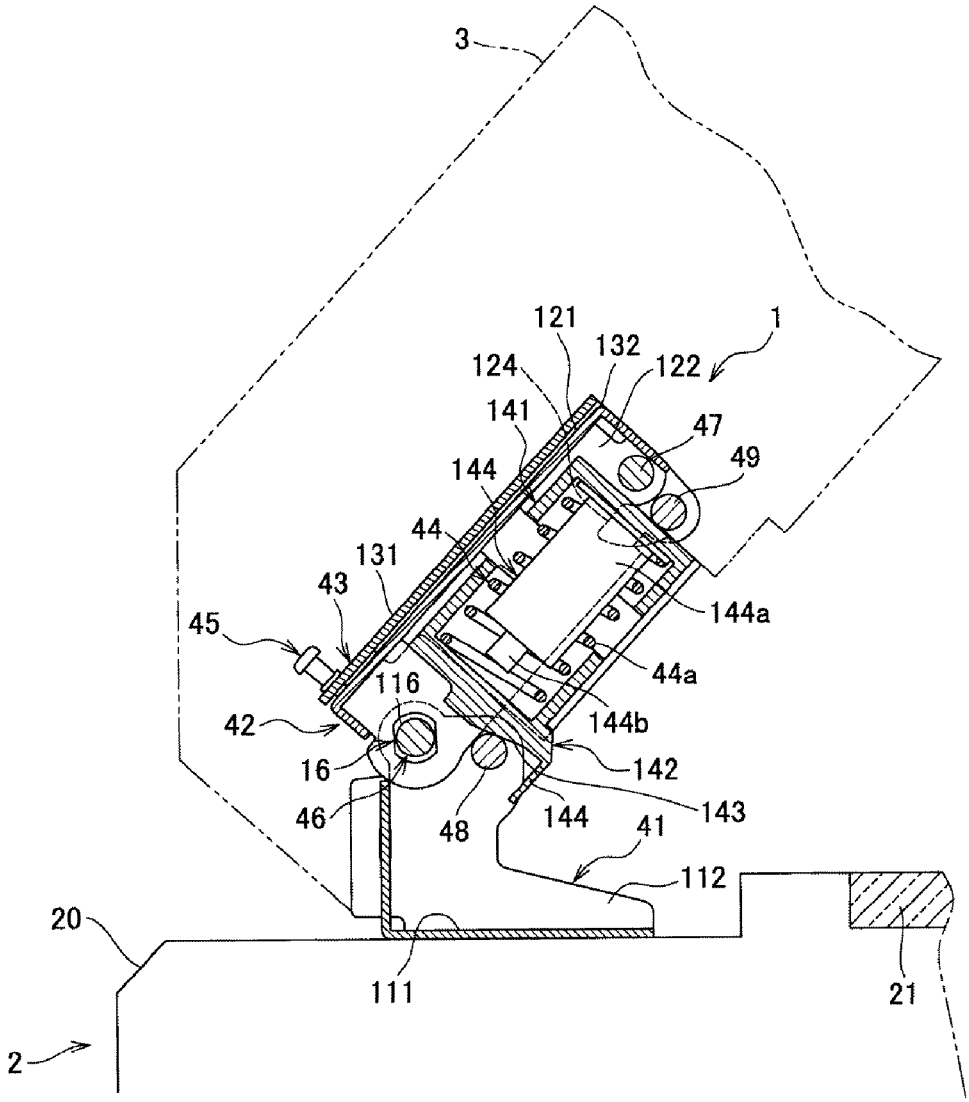
FIG. 7 is a sectional side view of an example of a first automatic original cover closer according to the present invention, specifically in an opened state.

FIG. 1 is a view of an example of an office equipment according to the present invention. FIGS. 2 to 5 are views of an example of a first automatic original cover closer according to the present invention. FIGS. 6 and 7 are views of an example of hinge portions according to the present invention. In a first automatic original cover closer according to the present invention an original cover 3 is rotatably mounted to rear ends of a main body 20 of an office equipment 2, as shown in FIGS. 1, 6 and 7. The office equipment 2 is not particularly limited, but includes for example a copying machine, a printer, a facsimile, a scanner, and the like, of which the copying machine is considered as being the most favorable. An automatic original feeder 31 e.g. is disposed on the original cover 3.

A first automatic original cover closer 1 according to the present invention is characterized, as shown in FIGS. 1 to 7, in that it is provided with hinge portions 4 having a supporting member 42 which supports an original cover 3 so as to be opened and closed with regard to a main body 20 of an office equipment 2, and with a driving portion 5 automatically opening and closing the original cover 3 by driving the supporting member 42 of the hinge portions 4. The automatic original cover closer 1 is further characterized in that the supporting member 42 is axially supported by a mounting member 41 attached to the main body 20 so as to be rotatable via a rotation shaft 46, the driving portion 5 comprises a driving motor and a driving force transmitting mechanism 52 which transmits a rotation drive force of the driving motor to the rotation shaft 46, and the rotation shaft 46 is adjusted so as to transmit the rotation drive force to the supporting member 42 via shaft engaging members 15, 16 fixedly attached to the supporting member 42.

Hinge portions 4, which are commonly called original cover closers, support an original cover 3 so as to be opened and closed with regard to a main body 20 of an office equipment 2, ordinarily two hinge portions 4 are used for such supporting function. These two hinge portions 4 may be identical to or different from each other provided that they can support the original cover 3 so as to be opened and closed with regard to the main body 20. An example shown in FIG. 1 describes two hinge portions 4 which are substantially identical and thus support the original cover 3 so as to be opened and closed with regard to the main body 20.

Each of hinge portions 4 is preferably equipped with a mounting member 41 mounted to a main body 20, a supporting member 42 pivotally supported on the mounting member 41 via a rotation shaft 46 so as to be rotatable together with the rotation shaft 46, a lifting member 43 overlapping the supporting member 42, pivotally supported thereon so as to be rotatable and mounted to an original cover 3, and a resilient means 44 disposed between the mounting member 41 and the supporting member 42 for urging the original cover 3 in an opening direction and the lifting member 43 in a direction in which it overlaps the supporting member 42. In the meantime, the opening direction herein refers to a direction in which the original cover 3 is rotated via the hinge portion 4 toward a direction away from a contact glass 21.

A mounting member 41 mainly comprises a bottom plate 111 detachably attached to a main body 20 and both side plates 112, 112 extending from both side end portions of the bottom plate 111 in a direction perpendicular thereto (including a substantially perpendicular direction).

A bottom plate 111 is fabricated in a substantially rectangular form, and provided with a mounting hole 114 for attaching the plate to a main body 20 using a small screw, etc. Side plates 112 are fabricated in a shape substantially of the letter L together with the bottom plate 111, and shaft holes 116 through which a rotation shaft 46 is inserted via shaft bearings 119 are disposed at the tip (upper portion) of the side plate 112. In other words, the shaft bearings 119 are mounted to the shaft holes 116 and the rotation shaft 46 is inserted through the shaft holes 116 (see FIG. 8). Fixing pin holes (not shown) are provided toward the bottom plate 111 (downward) and displaced inwardly (forward) from the shaft holes 116 of the side plate 112. A fixing pin 48 is inserted through both the fixing pin holes of the side plates 112. The fixing pin 48 is a pressure bearing member which an outer bottom surface of a first end portion of a resilient means 44 to be mentioned below, that is a second slider 142 to be mentioned below, abuts against. The pressure bearing member is not limited to a pin such as the fixing pin 48, but also includes a roller, for example a pressure bearing roller.

A supporting member 42 comprises, as shown in FIGS. 2 to 9, a top plate 121, both side plates 122, 122 extending from both side end portions of the top plate 121 in a direction perpendicular thereto (including a substantially perpendicular direction) and facing each other, and guide plates 123, 123 respectively made up of a tip of one of the side plates 122 bent at 90 toward the opposing side plate 122.

A hinge pin hole 127 through which a hinge pin 47 is inserted as well as a notch portion 124 for accepting a actuating pin 49 are disposed at one end portion (tip) of both side plates 122, 122. Shaft fixing holes 126*a*, 126*b* are disposed at other end portion (rear end portion) of both side plates 122, 122. The shaft fixing holes 126*a*, 126*b* are fabricated with a cross-section of a circle of which opposing bow sections are cut off so that the remaining part has parallel straight lines on opposite edges, and thus fabricated in a substantially oval form. However, one shaft fixing hole 126*a* (hereinafter the hole may be referred to as a first shaft fixing hole 126*a*) is substantially oval but slightly larger than other shaft fixing hole 126*b* (hereinafter the hole may be referred to as a second shaft fixing hole 126*b*). The shaft engaging members 15, 16 are inserted through the shaft fixing holes 126*a*, 126*b* and thus fixed thereto. In the meantime, a reference numeral 128 in FIG. 4 denotes one of through holes.

As per shaft engaging members 15, 16, a first shaft engaging member 15 is inserted through a first shaft fixing hole 126*a*, while a second shaft engaging member 16 is inserted through a second shaft fixing hole 126*b*. As compared to the second shaft engaging member 16, the first shaft engaging member 15 is adjusted to be slightly larger, however, both of the shaft engaging members are fabricated in a substantially identical form as a whole, that is a substantially cylindrical form. In other words, the first and the second shaft engaging members 15, 16 comprise, for example, insertion portions 15*a*, 16*a* respectively of a substantially oval outer profile which is fittingly inserted into the first and the second shaft fixing holes 126*a*, 126*b* respectively and thus inserted thereto, flange portions 15*b*, 16*b*, and engaging holes 15*c*, 16*c* opened in a hexagonal inner profile so that a rotation shaft 46 is fittingly inserted. The first shaft engaging member 15 is adjusted so as to be located on the same axis with the second shaft engaging member 16, by inserting the first shaft engaging member 15 and the second shaft engaging member 16 respectively through the first shaft fixing hole 126*a* and the second shaft fixing hole 126*b*. In the meantime, the shaft engaging members 15, 16 are attached to both of the side plates 122 of the supporting member 42, but arrangements are not limited to the above-mentioned, but the shaft engaging members may be attached to either one of the side plates 122.

Figure 4:
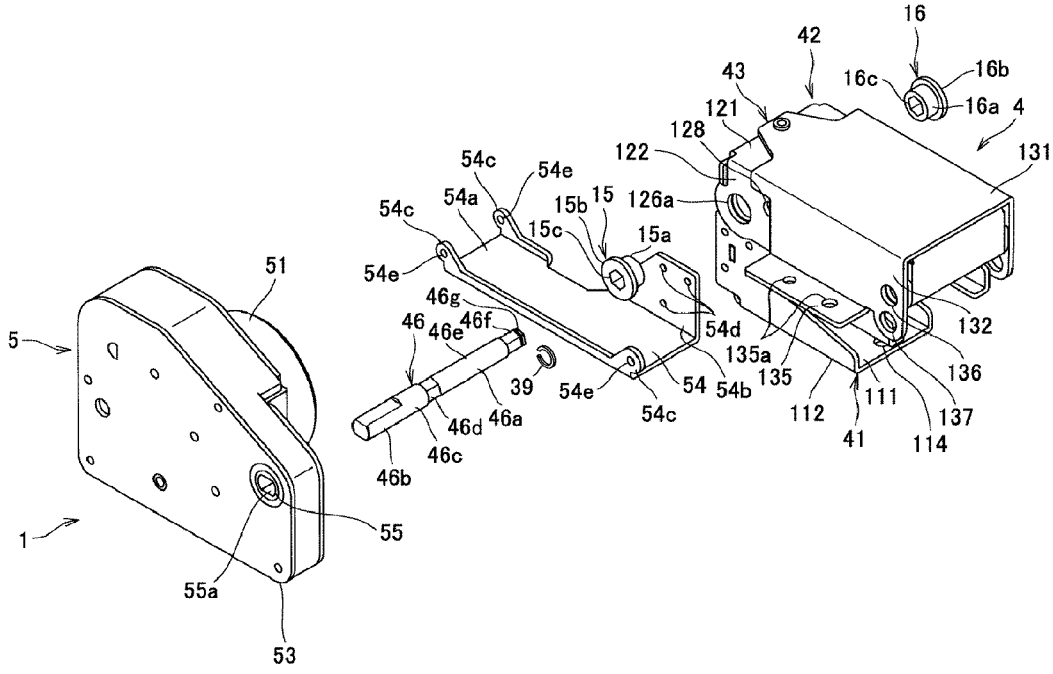
FIG. 4 is an exploded perspective view of an example of a first automatic original cover closer according to the present invention.
Figure 8:
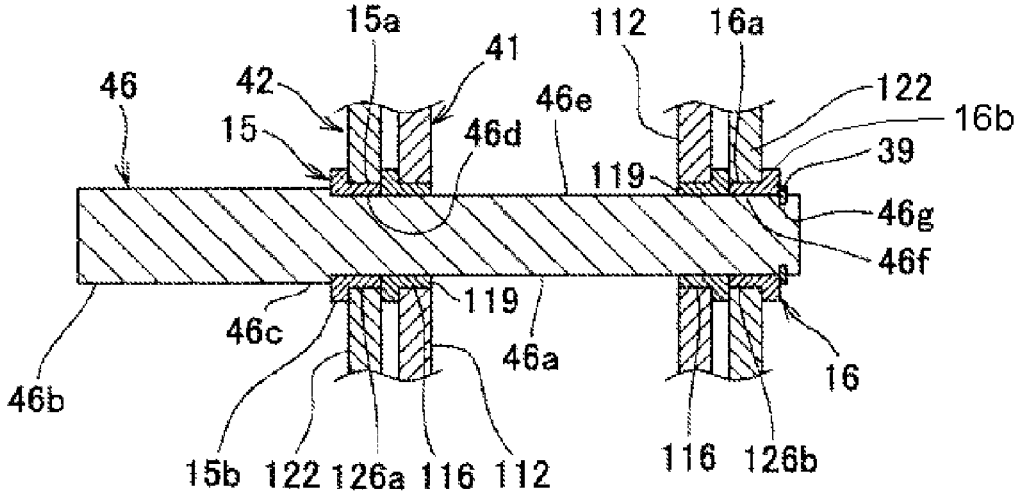
FIG. 8 is a sectional view of relations between a mounting member, a supporting member and a rotation shaft, all according to the present invention.
Figure 9:
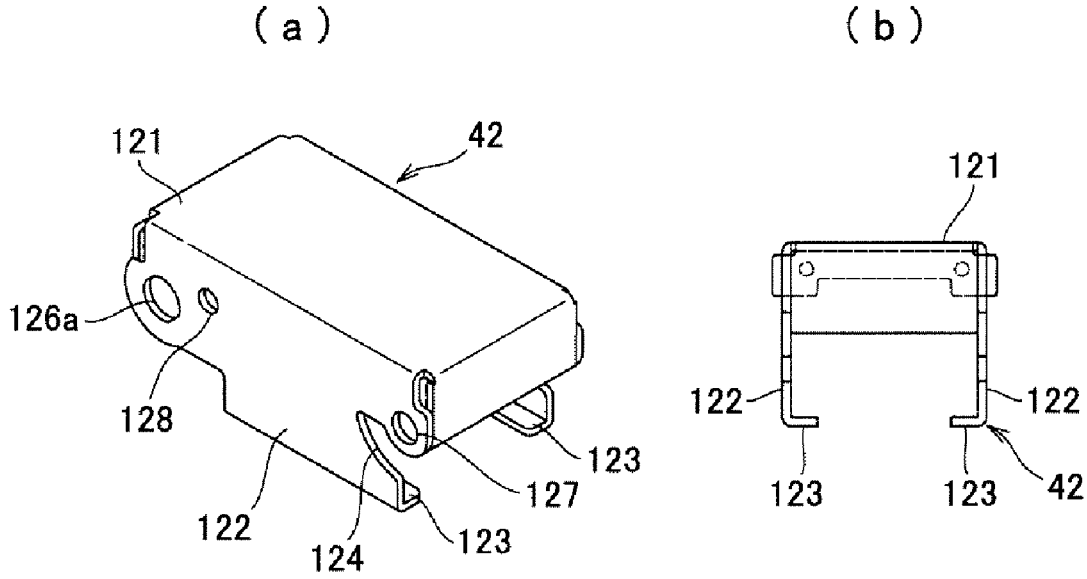
FIGS. 9A and 9B are views of an example of a supporting member according to the present invention, 9A being a perspective view and 9B being a front elevation view.
Figure 10:
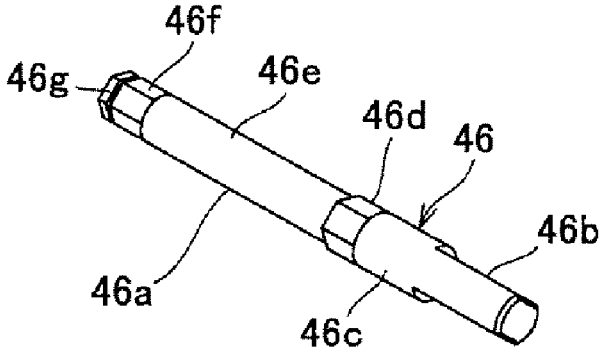
FIGS. 10A and 10B are views of an example of a rotation shaft according to the present invention, 10A being a perspective view and 10B being a side elevation.
Figure 10:
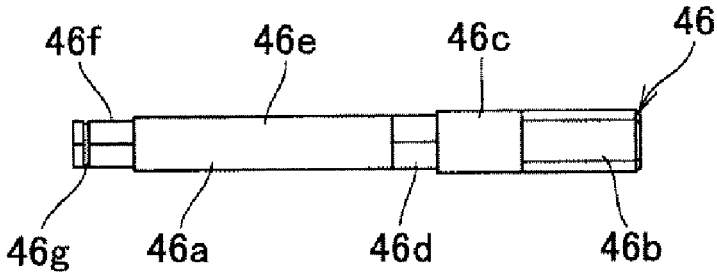
Figure 11:
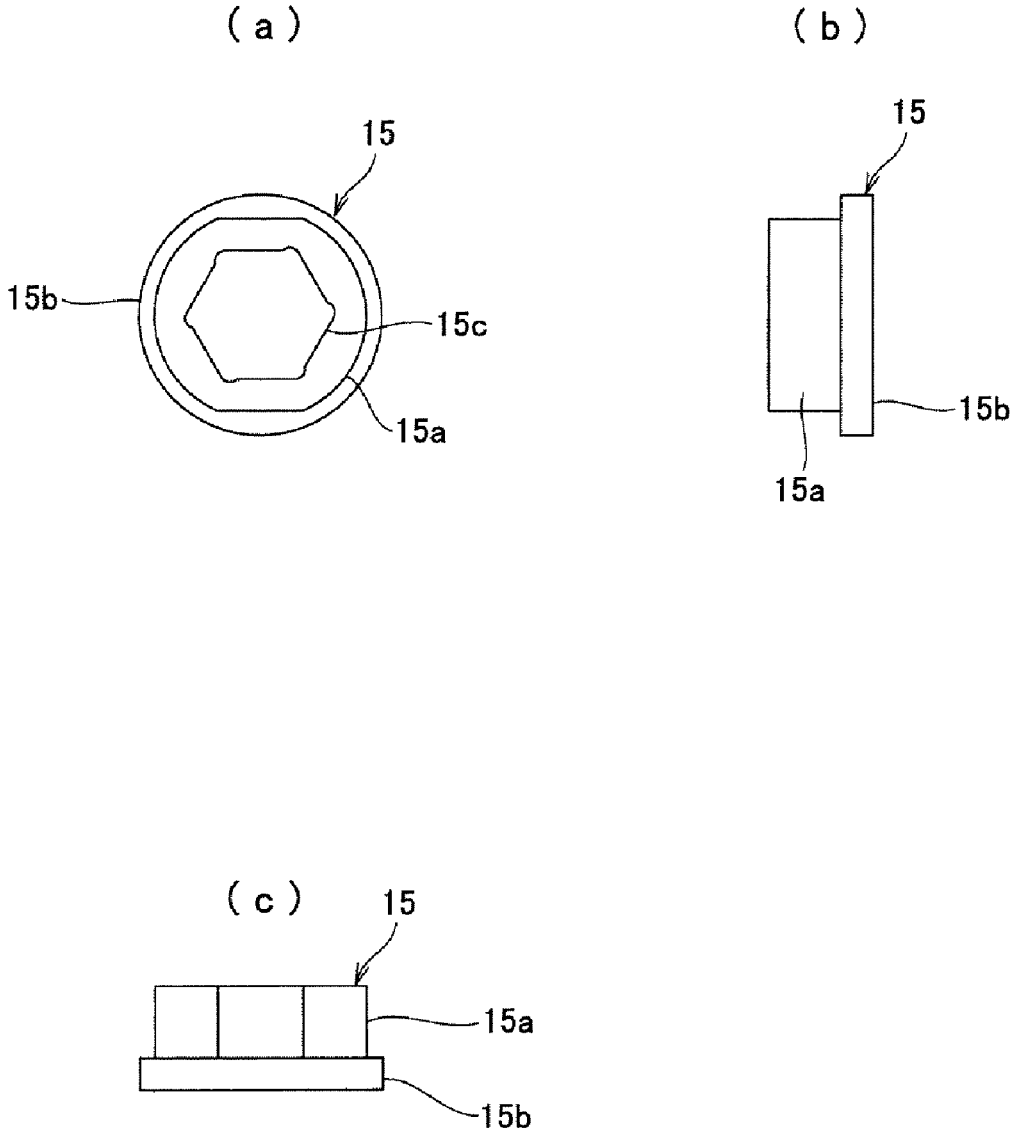
FIGS. 11A to 11C are views of an example of a first shaft engaging member according to the present invention, 11A being a plan view, 11B a side elevation, and 11C a front elevation view.

A rotation shaft 46 comprises, as shown in FIGS. 4, 8 and 11, a hinge shaft portion 46*a*, a driving shaft portion 46*b* and a coupling portion 46*c*, and is fabricated in a form substantially of a circular bar. The coupling portion 46*c* is provided between the hinge shaft portion 46*a* and the driving shaft portion 46*b*, is fabricated in a columnar shape. The driving shaft portion 46*b* is fabricated with a cross-section of a circle having the same diameter as the coupling portion 46*c*, of which opposing bow sections are cut off so that the remaining part has parallel straight lines on opposite edges, and thus fabricated in a substantially oval form, so that a driving shaft 55 of a driving portion 5 can be fittingly inserted thereto.

A size of a hinge shaft portion 46*a* is normally adjusted to a smaller diameter than that of a coupling portion 46*c*. A length (in an axial direction) of the hinge shaft portion 46*a* is so adjusted that the aforementioned portion penetrates both of the first and the second shaft engaging members 15, 16 inserted respectively through the first shaft fixing hole 126*a* and the second shaft fixing hole 126*b*. The hinge shaft portion 46*a* comprises a first engaging portion 46*d*, a supporting portion 46*e* and a second engaging portion 46*f*, which are aligned in this sequence from the coupling portion 46*c* to the end portion. The first engaging portion 46*d* is the largest in diameter, the supporting portion 46*e* the next largest, and the second engaging portion 46*f* the smallest. The first engaging portion 46*d* is fabricated in a substantially hexagonal shape and slightly smaller than an engaging hole 15*c* of the first shaft engaging member 15, so that the first engaging portion 46*d* is fittingly inserted into the engaging hole 15*c*. The supporting portion 46*e* is fabricated in a substantially columnar shape and slightly smaller in diameter than the first engaging portion 46*d*. The second engaging portion 46*f* is fabricated in a substantially hexagonal shape and slightly smaller than an engaging hole 16*c* of the second shaft engaging member 16, so that the second engaging portion 46*f* is fittingly inserted into the engaging hole 16*c*. A mounting groove 46*g* is disposed in vicinity of an end portion (tip) of a hinge shaft portion 46*a* (the second engaging portion 46*f*) for mounting E-ring 39, etc.

Once axes of an engaging hole 15*c* of a first shaft engaging member 15 attached to a first shaft fixing hole 126*a*, of an engaging hole 16*c* of a second shaft engaging member 16 attached to a second shaft fixing hole 126*b*, and of shaft bearings 119 attached to shaft holes 116 of a mounting member 41 are all aligned, a hinge shaft portion 46*a* is inserted starting from the engaging hole 15*c* of the first shaft engaging member 15 and penetrates all these holes. More specifically, a first engaging portion 46*d* is fittingly inserted into the engaging hole 15*c*, a supporting portion 46*e* is rotatably inserted into the shaft bearings 119 attached to shaft holes 116, and second engaging portion 46*f* into the engaging hole 16*c* of the second shaft engaging member 16. Once the hinge shaft portion 46*a* is inserted in the above-described manner, an E-ring 39 is for example attached to a mounting groove 46*g* located in a portion of the third shaft portion 46*f* protruding from the second shaft engaging member 16, when a wall forming a transition point between the hinge shaft portion 46*a* and a coupling portion 46*c* is in contact with an end surface of a flange portion of the first shaft engaging member 15. In this manner, the hinge shaft portion 46*a* of a rotation shaft 46 is fixed to a hinge portion 4 without escaping. As a result, a supporting member 42 is adjusted so that it can be coupled with a mounting member 41, so as to rotate together with the rotation shaft 46.

A lifting member 43 comprises, as shown in FIGS. 2 to 7, a top plate 131 to be detachably mounted via a small screw, etc. to a rear end side of an original cover 3 and both side plates 132, 132 extending from the both end portions of the top plate 131 in a direction perpendicular (including substantially perpendicular) thereto and facing each other, so that the member as a whole is fabricated in a shape of the letter U, and substantially covers a supporting member 42 in this manner. The both side plates 132, 132 are respectively provided with flanges 135, 135 having mounting holes 135*a*.

A hinge pin insertion hole 136 is cut through a point in vicinity of an end portion (tip) of a side plate 132 and on the side of top plate 131, and an actuating pin hole 137 is disposed below the hinge pin insertion hole 136, for accommodating an actuating pin 49. Once axes of the hinge pin insertion hole 136 of the both side plates 132 and of the hinge pin hole 127 of the both side plates 122, 122 of a supporting member 42 are all aligned, a hinge pin 47 is inserted into these holes. In this manner, a lifting member 43 and a supporting member 42 are coupled so as to be rotatable with regard to each other around an axis of the hinge pin 47. In the meantime, a reference numeral 139 in FIG. 3 denotes a through hole.

A horizontal position adjusting means 45 is preferably provided in vicinity of a rear end portion of a top plate 131 for adjusting a horizontal position of an original cover 3. The horizontal position adjusting means 45 comprises for example an adjusting screw 151 and a fixing nut 152, both located near the rear end portion of the top plate 131, and further at a center portion (including a substantially center portion) in a width direction. The fixing nut 152 is fixed to the top plate 131, and the adjusting screw 151 is screwed into the fixing nut 152; at this point, a tip of the adjusting screw 151 abuts against a top plate 121 of a supporting member 42, so that a distance between the supporting member 42 and a lifting member 43 is adjusted using the adjusting screw 151, and therefore the horizontal position of the original cover 3 is adjusted.

A resilient means 44 urges an original cover 3 so as to be rotatable in an opening direction, and a lifting member 43 into a direction in which it slides to overlap a supporting member 42. Further the resilient means 44 applies an urging force, smaller than a moment of the original cover 3, for urging the original cover 3, when the original cover 3 is opened at an angle equal to or less than a prescribed opening angle. The resilient means 44 has for example, a pair of sliders 141, 142 fitted into the supporting member 42 and a compression coil spring 44*a* disposed inside these sliders 141, 142. In the meantime, an opening angle in the present invention is an angle of the original cover 3 with regard to a surface of a contact glass 21 which is a top surface of a main body 20. A prescribed opening angle in the present invention is an angle at which the resilient means 44 applies an urging force smaller than a moment of the original cover 3, for urging the original cover 3.

A pair of sliders 141, 142 are fabricated respectively in a shape of box body with a rectangular cross section and an opening at their respective top surfaces. The sliders 141, 142 are fitted inside a supporting member 42 so as to be slidable independently from each other, with one of their respective openings facing the other. A compression coil spring 44*a* is accommodated between the sliders 141, 142. The sliders 141, 142 are adjusted respectively to a length such that they are fitted into the supporting member 42, when a bottom plate 111 of a mounting member 41 lies substantially in parallel to the supporting member 42 (a top plate 121) (for example when an original plate 3 is tightly contacted with a contact glass 21 on a top surface of a main body 20 (under a tight contact of original plate)).

As per compression coil spring 44*a*, its number is not particularly limited but one or more than two of such compression coil spring(s) 44*a* may be provided, and herein a single compression coil spring 44*a* is provided for example. It urges a pair of sliders 141, 142 in such a direction, that they are slid to be separated each other. The compression coil spring 44*a* rotatably urges an original cover 3 in an opening direction and applies an urging force smaller than a moment of the original cover 3, when the original cover 3 is opened at an angle below a prescribed opening angle (for example 20°, including angles around 20°).

A closure surface, which is an outer surface at a bottom of a slider disposed toward a tip (it may be called a first slider 141), presses a pressure via an urging force of a compression coil spring 44*a* an actuating pin 49, thus realizing a position at which a supporting member 42 overlaps a lifting member 43. In other words, with the urging force of the compression coil spring 44*a*, a tip of an adjusting screw 151 of a top plate 131 of the lifting member 43 abuts against a top plate 121 of the supporting member 42, so that the top plate 131 of the lifting member 43 overlaps, or substantially overlaps the top plate 121 of the supporting member 42.

An inclined portion 143 is provided on an outer surface at a bottom of a slider disposed toward a rear end portion (it may be called a second slider 142). The inclined portion 143 includes a point abutting against a fixing pin 48. In other words, the point abutting against a fixing pin 48 slides along the inclined portion 143 and then the second slider 142 slides via a compression coil spring 44*a* inside a supporting member 42 towards the rear end portion, when an original cover 3 is rotated via a rotation shaft 46 in an opening direction from a close contact of an original cover 3 with a contact glass 21, that is its closed position (see FIG. 6). As a result the compression coil spring 44*a* gradually expands. When the original cover 3 is opened up to the maximum opening angle for use, its rotation is restricted via an original cover rotation restricting mechanism (not shown). In the meantime, a reference numeral 145 in FIGS. 6 and 7 denotes an extended piece. The extended piece 145 is preferably fabricated with a width slightly smaller than the second slider 142. Due to the arrangement of the extended piece 145 in this way, an outer circumferential surface of the fixing pin 48, even if it is coated with lubricant grease for its smooth slidable contact with the second slider 142, is free from a contact with an end portion of an original, which causes spots on the portion of the original, because the extended piece 145 covers the most part of the outer circumferential surface of the fixing pin 48. This effect also applies to an end portion of an original touching the extended piece 145 when the original is removed from or set on a contact glass.

The maximum opening angle for use in the present invention herein refers to an angle of an original cover 3 with regard to a surface of a contact glass 21 which is an upper surface of a main body 20, and in particular that at which a rotation in an opening direction of the original cover 3 is restricted. The maximum opening angle for use is not particularly limited but is preferably 60° (including angles around 60°) to 70° (including angles around 70°), and e.g. 65° (the term includes angles around 65°).

Driving portions 5 are provided for automatically opening and closing an original closer 3 via a supporting member 42 by automatically driving hinge portions 4. Two driving portions 5 may be placed respectively on respective two hinge portions 4 of a main body 20, but a single driving portion 5 may be disposed exclusively on one of the hinge portions 4 onto which a center of gravity is shifted due to an automatic original feeder 31, as shown in FIG. 1, so that merely the corresponding hinge portion 4 is automatically driven. The driving portion 5 is, as shown in FIG. 5, equipped with a driving motor rotatable in the clockwise and anticlockwise directions, a driving force transmitting mechanism 52 which transmits a rotation drive force of the driving motor to the rotation shaft 46 at a reduced speed, and is fabricated so as to allow also for a rotational operation by hands.

A driving motor is not particularly limited provided that it can automatically drive hinge portions 4, but a pulse motor 51, etc. is desirable for the driving motor. The pulse motor 51 is detachably attached to a side surface of a driving case 53. The driving case 53 is placed on a mounting plate 54 and detachably attached thereto via small screws, etc.

Figure 5:
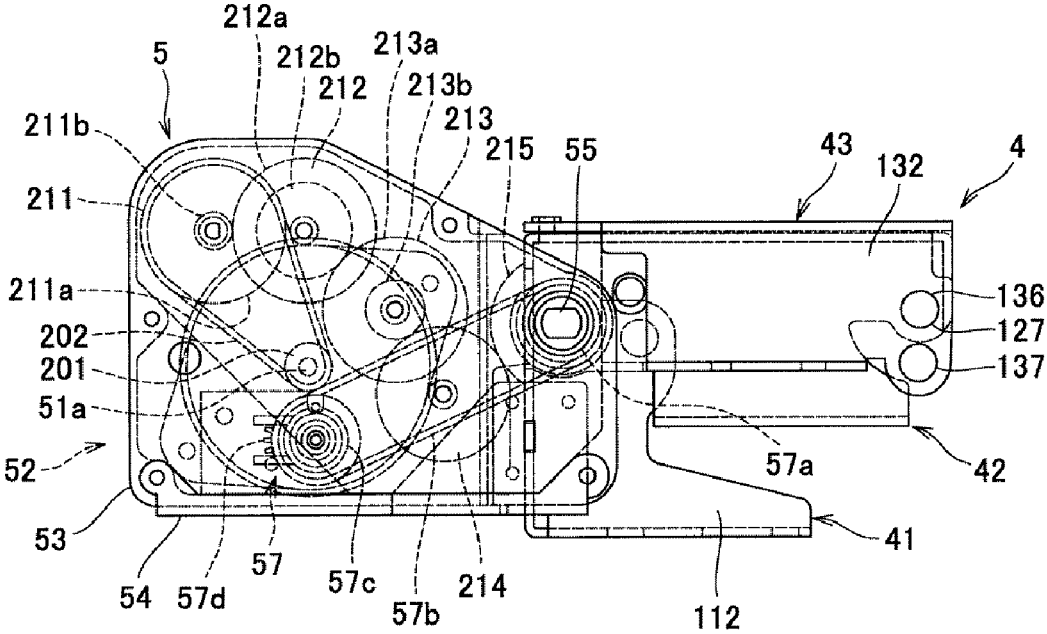
FIG. 5 is a side view of an example of a first automatic original cover closer according to the present invention.

A mounting plate 54 comprises for example, as shown in FIGS. 4 and 5, a bottom plate 54*a* in a shape of an elongated rectangular plain, on which a driving case 53 is placed, and mounting pieces 54*b*, 54*c* extending in a direction perpendicular to the bottom plate 54*a*, heightwise above (including substantially above) from the four corners at the end portions on both sides of the bottom plate 54*a*. A mounting piece at a corner nearest to a hinge portion 4 (it may be referred to as a first mounting piece 54*b*) is provided for mounting the mounting plate 54 to a side plate 112 of a mounting member 41 of the hinge portion 4. The first mounting piece 54*b* is fabricated so that it is higher and wider in dimension than the remaining mounting pieces, and it is provided with three mounting holes 54*d* for mounting the mounting plate 54 via small screws, etc. to a side plate 112. The remaining mounting pieces, that is the mounting pieces 54*c* at the three remaining corners of the mounting plate 54 are respectively provided with a mounting hole 54*e* for mounting the driving case 53. A driving force transmitting mechanism 52 is disposed in the driving case 53.

A driving force transmitting mechanism 52 is not particularly limited provided that it can transmit a rotation drive force of a pulse motor 51 to the driving shaft 55 at a reduced speed. It is equipped for example with five gears rotatably supported inside a driving case 53, which are respectively referred to as a first gear 211, a second gear 212, a third gear 213, a forth gear 214, a fifth gear 215 in the following. More specifically, a driving pulley 201 is attached to a rotation axis 51*a* of the pulse motor 51. The first gear 211 has a driven pulley 211*a* and a small gear 211*b* of a smaller diameter than the driven pulley 211*a*. The second gear 212 has a large gear 212*a* and a small gear 212*b* of a smaller diameter than the large gear 212*a*. The third gear 213 has a large gear 213*a* and a small gear 213*b* of a smaller diameter than the large gear 213*a*. A driving shaft 55 is attached to the fifth gear 215 on the same axis.

A timing belt 202 is trained about a driving pulley 201 of a rotation axis 51*a* of the pulse motor 51 and a driven pulley 211*a* of a first gear 211. A small gear 211*b* of the first gear 211 is meshed with a large gear 212*a* of a second gear 212, a small gear 212*b* of the second gear 212 with a large gear 213*a* of a third gear 213, a small gear 213*b* of the third gear 213 with a forth gear 214, and then the forth gear 214 with a fifth gear 215. Therefore, a rotation drive force of a pulse motor 51 is transmitted via the timing belt 202 through the first to fifth gears 211, 212, 213, 214, 215 to a driving shaft 55 at a reduced speed. The driving shaft 55 is connected with a rotation shaft 46. A connection of the driving shaft 55 with a rotation shaft 46 is not particularly limited, but it may also be realized using an engaging hole 55*a* which is cut through the driving shaft 55 on the same axis with a cross-section of a circle of which opposing bow sections are cut off, so that a driving shaft portion 46*b* of the rotation shaft 46 is fittingly inserted into the engaging hole 55*a*. The coupling between the shafts may be realized using an additional gear or pulley attached to the rotation shaft 46 and the driving shaft 55, therefore due to meshing via the gear or using a timing belt.

A clutch mechanism (not shown) is preferably provided on a driving force transmitting mechanism 52 for canceling a transmission of a driving force of a pulse motor 51 to a rotation shaft 46. The clutch mechanism is not particularly limited provided that it can intermittently transmit a rotation force of the pulse motor 51 and the rotation shaft 46, but a mechanical one is also accepted.

Furthermore, a controller 23 for example is provided on the main body 20, as shown in FIG. 1. The controller 23 controls a pulse motor 51, etc. in rotation in an opening or a closing direction of an original cover 3. In the meantime, the controller 23 is provided on the main body 20, in an embodiment shown in FIG. 1, but is not limited to this arrangement. The closing direction in this invention refers to a direction of movement of the original cover 3, when it rotates via hinge portions 4 and approaches to a contact glass 21. The controller 23 is provided with an automatic opening rotation function, which drives the pulse motor 51 by pressing an automatic opening switch 25 of original cover disposed on a control panel 22 so that the original cover 3 can be automatically rotated in the opening direction.

An automatic opening rotation function may also be so adjusted that the function enables a pulse motor 51 to immediately start its drive by pressing an automatic opening switch 25 of original cover, in order that an original cover 3 can be automatically rotated in the opening direction. However, it is preferable to adjust the automatic opening switch 25 of original cover so that the switch starts the drive of the pulse motor 51 only after a manual rotation of the original cover 3 up to a predetermined opening angle in order to automatically rotate it in an opening direction up to a maximum opening angle for use (including a substantially maximum opening angle for use). In other words, when the original cover 3 arrives at the predetermined opening angle starting from a closed position, the pulse motor 51 preferably turns on and the original cover 3 is automatically rotated up to the maximum opening angle for use (including the substantially maximum opening angle for use). Due to an above-mentioned arrangement, the original cover 3 can be rotated in an opening direction without applying a large torque on it, thus realizing a downsizing in a pulse motor 51 and a driving force transmitting mechanism 52.

Furthermore, a controller 23 is provided with an automatic closing rotation function, which drives the pulse motor 51 by pressing an automatic closing switch 26 of original cover disposed on a control panel 22 of a main body 20 so that the original cover 3 located at an opened position can be automatically rotated in the closing direction. In the meantime, the opened position herein means a position at which the original cover 3 allows for a placing of the original on a contact glass 21, that is positions such as that at which the original cover 3 is opened at a maximum opening angle for use (including a substantially maximum opening angle for use).

An automatic closing rotation function is not particularly limited provided that it can realize an automatic rotation in the closing direction of the original cover 3 located at an opened position, but it is preferably so adjusted that, when an original cover 3 is automatically rotated and closed to a predetermined closing angle or less, it can stop a drive of a pulse motor 51 or cancel a rotation driving force transmission to a rotation shaft 46 using a clutch mechanism so that it can be rotated in a closing direction either manually or by its own weight. The above-described automatic closing rotation function is a first automatic closing rotation function. In other words, when an original cover 3 is automatically rotated and closed to an angle less than a predetermined closing angle, the first automatic closing rotation function for example turns off the pulse motor 51, so that the original cover 3 can be closed either manually or by its own weight.

In the meantime, a closing angle in the present invention means an angle of an original cover 3 with regard to a surface of contact glass 21, which is a top surface of a main body 20, so the angle is the same as an opening angle, but in referring to a rotation of the original cover 3 in a closing direction, the term "closing angle" may be used for an angle of an original cover 3 with regard to a surface of contact glass 21, only for the purpose of illustration. A predetermined closing angle in the present invention is not particularly limited if the angle is less than the above-mentioned predetermined opening angle, but may be, for example 15° (including angles around 15°).

Furthermore, a fluid damper device 144 is preferably installed inside the above-mentioned compression coil spring 44*a*. The fluid damper device 144 is so actuated that it reduces a rotation speed of an original cover 3, exclusively at a predetermined closing angle or less of the original cover 3 (for example angles around 10° or less) in its rotation in a closing direction. The fluid damper device 144 includes an oil damper device, and the like. The fluid damper device 144 may be also installed in a direction contrary to the one illustrated in the present embodiment, so with a part corresponding to a cylinder 144*a* being attached to a second slider 142 and the side having a piston 144*b* to a first slider 141. Further, an arrangement of hinge portions 4 is not limited to the present embodiment. In short, they only have to include a supporting member 42, and otherwise they are not particularly limited. They can be assembled with or without a lifting member 43.

An automatic closing rotation function may be also adjusted to a low speed in order to avoid a rotation from being generated manually or by own weight, to control an impact of an original cover 3 onto a main body 20, and to stably and closely contact the original cover 3 with the main body 20 The second automatic closing rotation function preferably controls a pulse motor 51 so that a rotation of the original cover 3 in a closing direction stops with the original cover 3 being closely contacted with the main body 20, using signals from an open/close sensor, angle detection sensor, and the like.

An open/close sensor 35 is for example provided in vicinity of hinge portions 4 of a main body 20 for determining whether an original cover 3 is located at an opened position or at a closed position. The open/close sensor 35 may include both contact type and non-contact type sensors, and a contact type sensor is illustrated in an example shown in the drawings. This contact type open/close sensor 35 transmits electric signal indicating that the original cover 3 is at the opened position, when a contact 36 urged in a protruding direction protrudes from the main body 20. And when the original cover 3 is closely contacted with the main body 20, due to a location of a contact 36 sinking into the main body 20 against the urging force, the sensor transmits electric signal indicating that the original cover 3 is at the closed position.

An angle detection sensor for example detects an angle of a driving shaft 55, so that an angle of an original cover 3 with regard to a main body 20 can be detected, based on the detected angle of the driving shaft 55. The angle detection sensor includes for example the one using a rotary encoder, and it is installed, as shown in FIG. 5, inside a driving case 53. An angle detection sensor 57 is equipped for example with a first pulley 57*a* disposed coaxially on the driving shaft 55, a second pulley 57*c* coupled with the first pulley 57*a* using a timing belt 57*b* and fabricated so as to have a diameter equal to the first pulley 57*a*, and a detecting portion 57*d* for transmitting detected signals via a rotation of the second pulley 57*c*. The detecting portion 57*d* may be both of contact type and non-contact type. The above-mentioned detection sensor 57 detects the angle of the driving shaft 55, thus the angle of the original cover 3 in opening and closing. In the meantime, the angle detection sensor 57 is described with reference to the case where it is disposed inside the driving case 53, but its arrangement is not limited to the case: the angle detection sensor 57 may be disposed outside the driving case 53, or at other positions.

Furthermore, an automatic opening rotation function, a first and a second automatic closing rotation functions are preferably provided respectively with a stopping function which stops a drive of a pulse motor 51 when a remarkable torque different from the one for rotating an original cover 3 is generated during an automatic rotation of the original cover 3 in an opening or a closing direction. A torque detection sensor which serves as a means for detecting a torque may be disposed on a driving shaft 55, a rotation shaft 46, and the like. The stopping function may also be so adjusted that, in case that the angle of the driving shaft 55, as compared to an assumed angle of the same obtained from an angle detection sensor 57, is displaced from the latter, it determines that a large torque is generated and stops the drive of the pulse motor 51.

Furthermore, a controller 23 is preferably equipped with a function preventing undesired omission of closing step. The function preventing undesired omission of closing step determines that an original cover 3 is subject to an undesired omission of closing step in case that the original cover 3 is located at an opening position even after a predetermined period of time, so that the function allows the original cover 3 to be automatically rotated in a closing direction. With such a function preventing undesired omission of closing step, an undesired omission of closing step of the original cover 3 is successfully prevented.

Further, a controller 23 is preferably provided with an aiding function for generating an aiding force in rotating an original cover 3 in an opening or a closing direction. The aiding function works so that it can aid a rotation of the original cover 3 at its predetermined angle based on signals from the angle detection sensor 57, for example when the original cover 3 is rotated without an automatic opening switch 25 of original cover and an automatic closing switch 26 of original cover being actuated. Especially an aiding function in a rotation in a closing direction preferably comprises a function driving a pulse motor 51 so that the original cover 3 is rotated at a low speed when it is located at a predetermined closing angle or less (for example angles around 10° or less) during its rotation in a closing direction. With such an aiding function, a manual rotation of the original cover 3 can be easily realized.

Moreover, an aiding function may also work so that it can drive a pulse motor 51 for detecting a rotation state of an original cover 3 based on signals from an angle detection sensor 57, and for aiding a rotation of the original cover 3, when the original cover 3 is manually rotated in an opening or a closing direction from a position at which it stops, without an automatic opening switch 25 of original cover and an automatic closing switch 26 of original cover being actuated. In other words, the aiding function may also be so adjusted that an aiding force is applied in accordance with a movement of the original cover 3 and thus merely a slight force is required for opening/closing the original cover 3. In this manner, a manual opening/closing of the original cover 3 can be easily realized.

In addition, a controller 23 preferably has an automatic opening/closing function. The automatic opening/closing function may be so adjusted for example that it can drive a pulse motor 51 for opening and closing an original cover 3 based on signals from an angle detection sensor 57, when the original cover 3 is manually rotated in an opening or a closing direction from a position at which it stops, without an automatic opening switch 25 of original cover and an automatic closing switch 26 of original cover being actuated. In other words, the automatic opening/closing function may be so adjusted that an automatic opening or closing of the original cover 3 in its direction of movement is also initiated, when the original cover 3 is manually opened or closed. Accordingly, a manual opening/closing of the original cover 3 can be easily realized.

Further a controller 23 may be so adjusted that it can control a clutch mechanism so as to allow a rotation drive force of a pulse motor 51 to be transmitted to a rotation shaft 46 during a drive of the pulse motor 51 and to cancel a transmission of a rotation drive force of the pulse motor 51 while it is not driven.

In the following, an operation of an automatic original cover closer according to the present invention will be described.

The original cover 3 is closely contacted with the contact glass 21 of the main body 20, and thus adjusted to the closed position in a state where the main body 20 of the office equipment 2 is not used, as shown in FIG. 6. The original cover 3 is manually rotated for putting the original onto the contact glass 21 of the main body 20 by grasping the front side (the end portion opposite to the hinge portions 4, or in its vicinity) of the original cover 3 and lifting the cover upwards. In other words, the original cover 3 is rotated around the axis of the rotation shaft 46 so as to expose the surface of the contact glass 21 to the outside and place the original cover 3 at an opening position. When the original cover 3 is rotated in the opening direction, it is rotatably urged due to the urging force of the compression coil spring 44*a*, thus enabling a rotation in the opening direction, without giving too much feeling of weight to the users.

Further, the original cover 3 is automatically rotated in the opening direction for example by pressing the automatic opening switch 25 of original cover. The pulse motor 51 is activated directly after pressing the automatic opening switch 25 of original cover, or otherwise, when the original cover 3 is manually rotated in the opening direction. Due to the drive of the pulse motor 51, the rotation drive force of the pulse motor 51 is transmitted via the driving force transmitting mechanism 52 to the driving shaft 55, which then transmits the force to the rotation shaft 46. Therefore the original cover 3 is automatically rotated in the opening direction. In this way, the contact glass surface is exposed to the outside, so that the original cover 3 is opened up to the opened position.

Once the original is placed on the surface of the contact glass 21 which is exposed in the above mentioned manner, the original cover 3 lifted upwards is manually lowered in the following manner: when the original cover 3 is rotated in the closing direction, it is rotated (shifted downward) around the axis of to the rotation shaft 46 in the direction in which the original cover 3 is brought into contact with the contact glass 21. At that point, is rotated downward around the axis of to the rotation shaft 46 with the tip of the adjusting screw 151 on the top plate 131 of the lifting member 43 abutting against the top plate 121 of the supporting member 42 due to the urging force of the compression coil spring 44*a*, in other words, preventing the original cover 3 (the lifting member 43) from rotating around the axis of the hinge pin 47.

In case that the original cover 3 is rotated in the closing direction in the above-described manner, some force is required in the beginning, since the rotation proceeds against the urging force of the compression coil spring 44*a*. However, at a closing angle of 20° (including angles around 20°) or less, the original cover 3 can be easily rotated, because the moment of the original cover 3 is larger than the urging force of the compression coil spring 44*a* which urges the original cover 3. At this point, the rotation speed of the original cover 3 in the closing direction is accelerated, while at an opening angle of 10° (including angles around 10°) or less, a rotation speed of the original cover 3 is reduced due to the fluid damper device 144. As a result, given that the rotation speed is controlled via the fluid damper device 144, an intensive collision of the original cover 3 with the contact glass 21 is avoided. Furthermore, even without the fluid damper device 144, the rotation speed of the original cover 3 is reduced due to a coupling of the rotation shaft 46 with the driving shaft 55 and to a transmission of the rotation force of the rotation shaft 46 to the driving force transmitting mechanism 52 and the pulse motor 51 and the like, thus preventing the intensive collision of the original cover 3 with the contact glass 21.

Further in case that the original is voluminous in thickness like a thick book, when the original cover 3 is rotated in the closing direction (shifted downwards), only a portion of the original cover 3 located in vicinity of the supporting member 42 is contacted with the end portion of the original on the side of the supporting member 42 or its vicinity, and thus a clearance is created between the end portion of the original opposite to the side of the supporting member 42 and the original cover 3. In other words, the original cover 3 is then unstable at the position. When the original cover 3 which is unstable is pressed toward the contact glass 21, the actuating pin 49 presses the first slider 141 toward the second slider 142, and then the first slider 141 slides against the urging force of the compression coil spring 44*a* toward the second slider 142. In this manner the original cover 3 is rotated around the axis of the hinge pin 47. In other words, the original cover 3 moves so that the upper surface of the original is covered. In case that the upper surface of the original is flat for example, the original cover 3 is surface-contacted with the upper surface. Accordingly, the voluminous original is stably and closely contacted with the surface of the contact glass 21.

Still further, the original cover 3 is automatically rotated in the closing direction for example by pressing the automatic closing switch 26 of original cover. The pulse motor 51 is activated by pressing the automatic closing switch 26 of original cover in this manner, so as to be rotated in a direction contrary to in the opening direction. The rotation drive force of the pulse motor 51 is transmitted via the driving force transmitting mechanism 52 to the driving shaft 55, which then transmits the force to the rotation shaft 46. Therefore the original cover 3 at the opening direction is automatically rotated in the closing direction.

In case that the controller 23 is equipped with the first automatic closing rotation function, the original cover 3 automatically rotated in the closing direction continues its rotation manually or by own weight at a predetermined closing angle of 15° (including angles around 15°) or less, since the drive of the pulse motor 51 stops or the transmission of rotation drive force of the pulse motor 51 to the rotation shaft 46 is canceled due to an activation of the clutch mechanism. At this point, at a closing angle of 10° (including angles around 10°) or less, a rotation speed of the original cover 3 is reduced due to the fluid damper device 144. As a result, given that the rotation speed is controlled via the fluid damper device 144, an intensive collision of the original cover 3 with the contact glass 21 is avoided. Furthermore, even without the fluid damper device 144, the rotation speed of the original cover 3 is reduced due to a coupling of the rotation shaft 46 with the driving shaft 55 allowing for a transmission of the rotation force of the rotation shaft 46 to the driving force transmitting mechanism 52 and the pulse motor 51, and the like. Therefore, the intensive collision of the original cover 3 with the contact glass 21 is prevented.

On the other hand, in case that the controller 23 is equipped with the second automatic closing rotation function, when the original cover 3 is rotated in the closing direction by pressing an automatic closing switch 26 of original cover, it is rotated at a low speed so that it is closely contacted with the main body 20. A rotation of the original cover 3 at a low speed as has been described enables a control of the impact of the original cover 3 onto the main body 20 and a stable and close contact of the original cover 3 with the main body 20.

In this manner, since a coupling of the rotation shaft 46 with the driving shaft 55 allows for a transmission of the rotation drive force of the pulse motor 51 from the driving shaft 55 to the rotation shaft 46, the original cover 3 can be automatically rotated. As a result, the original cover 3 can be automatically rotated, with almost no modification to the layout of the hinge portions 4, in other words, using the conventional hinge portions 4. Therefore, systems for an automatic opening/closing of the original cover 3 can be easily arranged for a practical use.

In the present invention, the rotation shaft 46 is fittingly inserted into the first shaft engaging member 15 attached to the first shaft fixing hole 126*a*, as well as into the second shaft engaging member 16 attached to the second shaft fixing hole 126*b*. In this manner, the rotation drive force of the rotation shaft 46 is transmitted to the supporting member 42 via the shaft engaging members 15, 16 fixedly attached thereto, which enables an automatic drive of the supporting member 42, in other words the original cover 3 with regard to the mounting member 41 using substantially two members only. Accordingly, the automatic original cover closer 1 according to the present invention can reduce the number of parts used therein, and further allow for a simple structure and a reduced cost.

Furthermore, the driving portion 5 is attached via the mounting plate 54 to the mounting member 41 of the hinge portions 4, which enables the mount and removal of the driving portion 5 merely through the mount and removal of the hinge portions 4, and in this manner makes unnecessary a separate step of the mount and removal of the driving portion 5, which results in an improved operability during assembly and maintenance. In the meantime, an improved operability is herein sought by mounting the hinge portions 4 to the main body 20 and further the driving portion 5 via the mounting plate 54 to the hinge portions 4, but the solution is not limited thereto provided that operability is improved during assembly and maintenance, but the driving portion may also be mounted to the main body and the hinge portions via the mounting plate to the driving portion. This arrangement also enables the mount and removal of the driving portion merely through the mount and removal of the hinge portions, and in this manner makes unnecessary a separate step of the mount and removal of the driving portion, which results in an improved operability during assembly and maintenance.

In addition, the horizontal position adjusting means 45 is provided on the lifting member 43, which realizes an adjustment of the position of the original cover 3 with regard to the contact glass 21, and further more stable and close contact of the original cover 3 with the contact glass 21.

Moreover, the driving motor which is the pulse motor 51 can prevent damages to a motor, the driving force transmitting mechanism 52, and the like, since the pulse motor 51 steps out when a large torque different from the one rotating the original cover 3 is generated.

Figure 12:
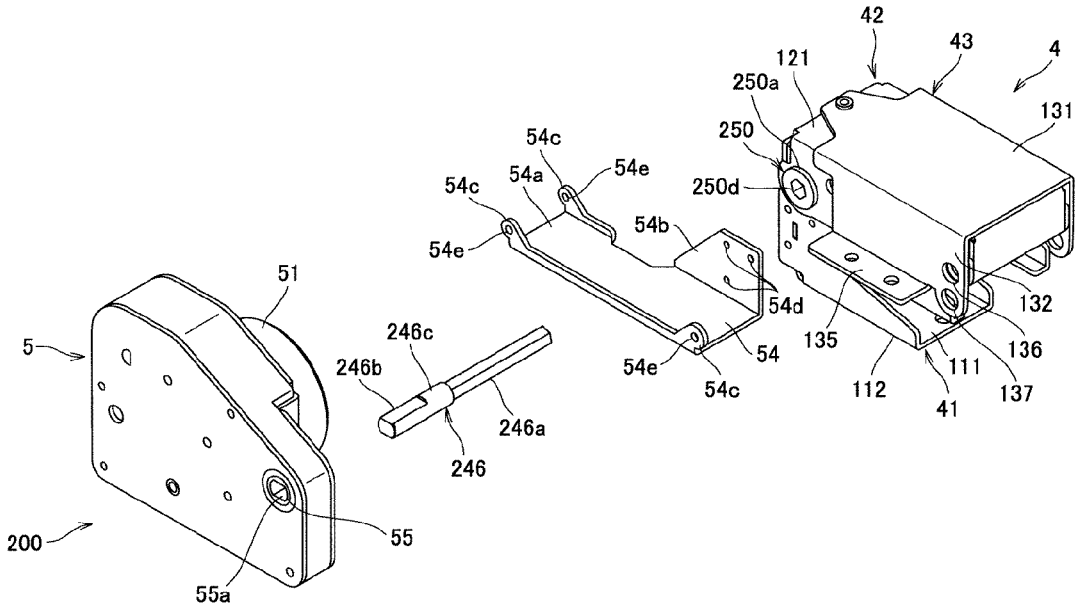
FIG. 12 is an exploded perspective view of an example of a second automatic original cover closer according to the present invention.

FIG. 12 shows an example of the second automatic original cover closer according to the present invention. The second automatic original cover closer according to the present invention is also arranged, in the same manner as the above-mentioned first automatic original cover closer, for a reduced number of parts used therein, a simple structure and reduced cost, as well as an improved operability, in that a shaft enclosing member 250 in a cylindrical shape which is used instead of shaft engaging member is axially supported on the mounting member 41 so as to be rotatable with regard thereto, and that a rotation shaft 246 is mounted to the shaft enclosing members 250 so as to rotate together with it. In other words, the second automatic original cover closer 200 according to the present invention enables an automatic opening/closing of the original cover 3 using two members which are the shaft enclosing members 250 and the rotation shaft 246. For the same elements as in the above-mentioned first automatic original cover closer 1 the same name is used, and the description thereof is often omitted.

Figure 13:
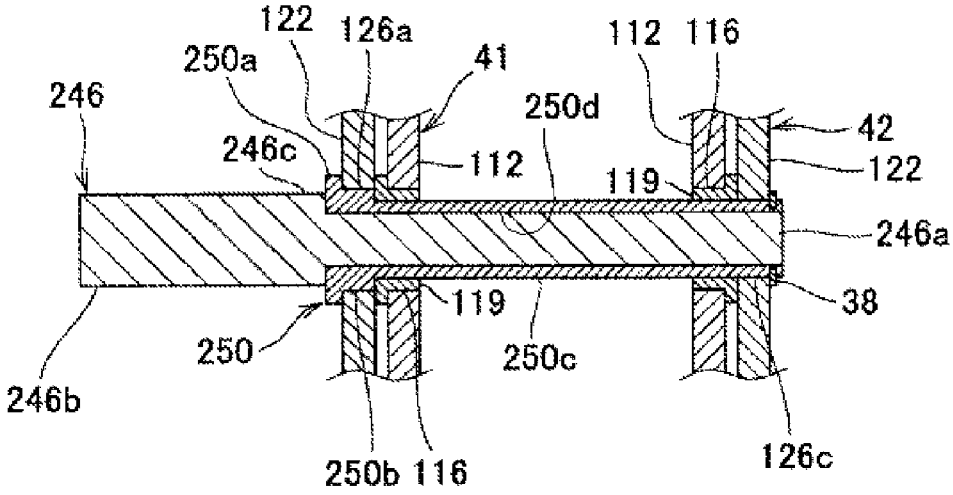
FIG. 13 is a sectional view of relations between a mounting member, a supporting member and a rotation shaft of a second automatic original cover closer according to the present invention.

A rotation shaft 246 comprises, as shown in FIGS. 12 and 13, a hinge shaft portion 246*a*, a driving shaft portion 246*b* and a coupling portion 246*c*, and is fabricated having a cross-section substantially of a circle and in a bar-like shape. The coupling portion 246*c* is provided between the hinge shaft portion 246*a* and the driving shaft portion 246*b*, and is adjusted to have a columnar shape. The driving shaft portion 246*b* is fabricated with a cross-section of a circle with opposing bow sections being cut off so that the remaining part has parallel straight lines on opposite edges, and thus fabricated in a substantially oval form, to which a driving shaft 55 of a driving portion 5 can be fittingly inserted. The hinge shaft portion 246*a* is fabricated in a substantially columnar shape and slightly smaller in diameter than the coupling portion 246*c*. A length (in an axial direction) of the hinge shaft portion 246*a* is preferably adjusted for example to the substantially same length as the shaft enclosing members 250.

Figure 14:
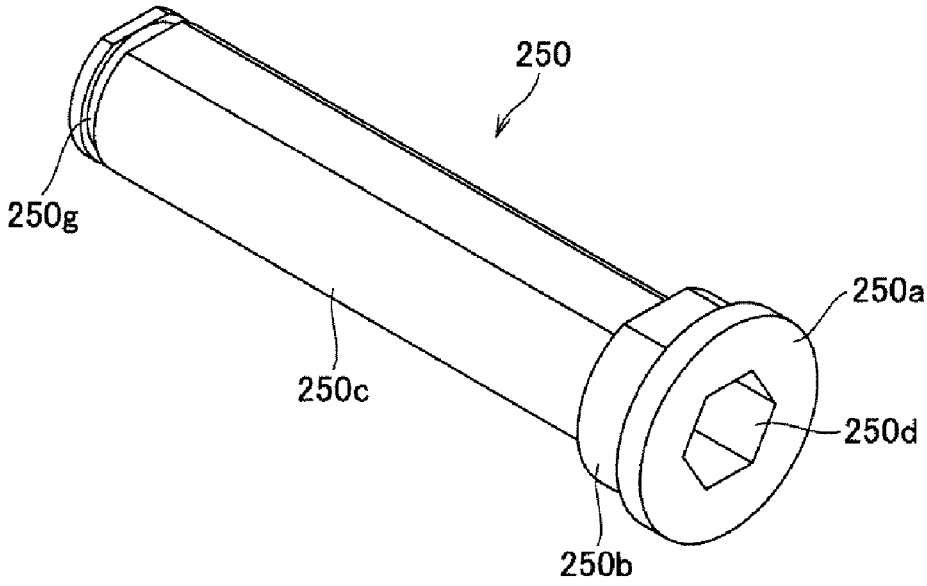
FIGS. 14A and 14B are views of an example of a shaft enclosing member according to the present invention, 14A being a perspective view and 14B being a front elevation view.
Figure 14:
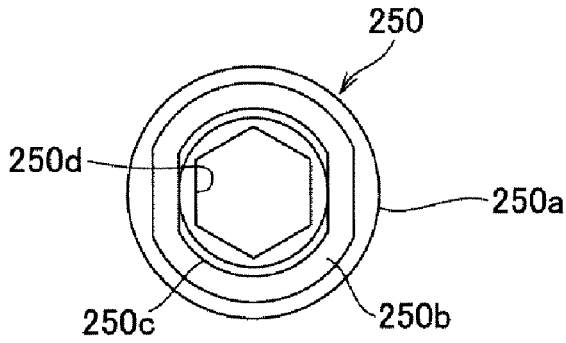

A shaft enclosing member 250 comprises, as shown in FIGS. 12 to 14, a flange portion 250*a*, and a first engaging portion 250*b* and a second engaging hinge portion 250*c*, and is a cylindrical shaft member fabricated in a shape substantially of cylindrical body. The shaft enclosing member 250 of a rotation shaft 246 has an inner profile in an anti-rotation shape, for example, a hexagonal shape into which a transmission shaft is fittingly inserted. And the inner profile is fabricated to serve as a shaft engaging portion 250*d*.

A flange portion 250*a* is fabricated in a shape of circle which is the largest in diameter. A first engaging portion 250*b* is provided between the flange portion 250*a* and a second engaging hinge portion 250*c*, and located at a position corresponding to that of a first shaft fixing hole 126*a*. The first engaging portion 250*b* is fabricated with a cross-section of a circle which is the largest next to the flange portion 250*a* and has the opposing bow sections of the first engaging portion 250*b* cut off, so that the remaining part has parallel straight lines on opposite edges, and is thus fabricated in a substantially oval form, to which the first shaft fixing hole 126*a* can be fittingly inserted. The second engaging hinge portion 250*c* is inserted into shaft bearings 119 attached to respective shaft holes 116 of a mounting member 41, as well as a second shaft insertion hole 126*c*, and fabricated in a shape of a circle with the opposing bow sections being cut off so that the remaining part has parallel straight lines on opposite edges, and thus fabricated in a substantially oval form, to which the second shaft fixing hole 126*c* can be fittingly inserted. A length (in an axial direction) of the shaft enclosing member 250 is adjusted in such a size that the aforementioned portion is inserted respectively through the first shaft fixing hole 126*a*, the shaft bearing 119 attached to shaft holes 116 and the second shaft fixing hole 126*c*, allowing the tip thereof to protrude from the second shaft fixing hole 126*c*. A mounting groove 250*g* is provided in vicinity of the tip of the shaft enclosing member 250 (the second engaging hinge portion 250*c*) for mounting an E-ring 38, and the like.

A tip of a second engaging hinge portion 250*c* is inserted first into a first shaft fixing hole 126*a*, and next shaft bearings 119 attached to respective shaft holes 116 and then a second shaft fixing hole 126*c*, so that a first engaging portion 250*b* is fitted into a first shaft fixing hole 126*a*, and then a second engaging hinge portion 250*c* into a second shaft fixing hole 126*c*. While a flange portion 250*a* abuts against side plates 122 of a supporting member 42, an E-ring 38 is attached to a mounting groove 250*g* on a portion of the second engaging hinge portion 250*c* protruding from the second shaft fixing hole 126*c*, thus allowing a shaft enclosing member 250 to be attached to hinge portions 4 without escaping. As a result, the supporting member 42 is rotatably coupled together with the shaft enclosing member 250 to a mounting member 41. In the meantime, the shaft enclosing member 250 is herein attached to the side plates 122 of the supporting member 42, but an arrangement is not limited thereto, and the shaft enclosing member 250 may be attached only to either one of the side plates 122 of the supporting member 42.

Even if manufactured as above described, the second automatic original cover closer 200 has the same operation and effect as the above-mentioned first automatic original cover closer 1. The shaft enclosing member 250 is fittingly inserted into the first shaft fixing hole 126*a* and the second shaft fixing hole 126*c*, and it is then coupled via the rotation shaft 246 to the driving shaft 55 of the driving portion 5. In this manner, a rotation drive force of the rotation shaft 246 is transmitted to the supporting member 42, via the shaft enclosing member 250 fixedly attached thereto. The supporting member 42, that is the original cover 3 can be thus automatically operated with regard to the mounting member 41 using substantially two members only, which are the rotation shaft 246 and the shaft enclosing member 250, and without mounting further a torque plate which has been conventionally necessary. Accordingly, the second automatic original cover closer 200 according to the present invention can reduce the number of parts used, and further allow for a simple structure and a reduced cost.

Moreover, the driving portion 5 is mounted via the mounting plate 54 to the mounting member 41 of the hinge portions 4. This arrangement realizes the mount and removal of the driving portion 5 merely through the mount and removal of the hinge portions 4, and in this manner makes unnecessary a separate step of the mount and removal of the driving portion 5, which results in an improved operability during assembly and maintenance. In the meantime, an improved operability is sought by mounting the hinge portions 4 to the main body 20 and further the driving portion 5 via the mounting plate 54 to the hinge portions 4, but the solution is not limited thereto provided that operability is improved during assembly and maintenance, but the driving portion may be mounted to the main body and the hinge portions via the mounting plate to the driving portion. This arrangement also enables the mount and removal of the driving portion 5 merely through the mount and removal of the hinge portions 4, and in this manner makes unnecessary a separate step of the mount and removal of the driving portion 5, which results in an improved operability during assembly and maintenance.

As described above, in an automatic original cover closer according to the present invention a rotation shaft is so adjusted that it transmits its rotation drive force to a supporting member via a shaft engaging member fixedly attached thereto. In this manner the automatic original cover closer can reduce a number of parts used, and realize a simple structure and a reduced cost. Furthermore, a coupling of a driving portion via a mounting plate to hinge portions or a coupling of hinge portions via a mounting plate to a driving portion improves operability during assembly and maintenance, so that the automatic original cover closer is suitably used in particular in a copying machine, a printer, a facsimile, a scanner, and the like.

What is claimed is:

1. An automatic original cover closer for an automatic opening and closing of an original cover with respect to a main body of an office equipment, said automatic original cover closer comprising:

hinge portions and a driving portion to transfer a driving power to the hinge portions;

said hinge portions comprising:

a mounting member having a bottom plate and two side plates extending from both side portions of the bottom plate upward in the orthogonal direction to the bottom plate respectively and attached said bottom plate to an upper portion of the main body; and a supporting member including a top plate and both side plates extending downward in a direction perpendicular to the top plate from both side portions of the top plate respectively, with said both side plates being axially supported via a rotation shaft on said both side plates of said mounting member so as to be rotatable with the rotation shaft;

said driving portion comprising:

a drive case attached to a mounting plate, said mounting plate being attached to either one of said side plates of said mounting member;

a positively and reversely rotatable drive motor attached to the drive case;

a driving shaft attached to said drive case so as to be co-rotatable with said rotation shaft; and a power transferring mechanism attached to said drive case for decelerating and transferring a rotary driving power of said drive motor to said driving shaft;

wherein said rotation shaft is constituted of a hinge shaft portion and a driving shaft portion, said hinge shaft portion having a first portion and a second portion engagibly inserted into shaft engaging members that are attached to said side plates of said supporting member, said hinge shaft portion is rotatably inserted in shaft bearings attached to said side plates of said mounting member, said driving shaft portion being coaxially connected with said driving shaft so that rotary driving power of said drive motor is transferred to said supporting member via said driving shaft and said rotation shaft.

2. The automatic original cover closer according to claim 1, wherein said hinge portions further comprises a lifting member having a top plate fixed to said original cover and two side plates extending downward from both end portions of the top plate in the orthogonal direction to the top plate respectively, with the side plates being axially supported on said side plates of said supporting member so as to be rotatable, and a resilient means to urge said lifting member in an opening direction of said original cover and said lifting member in a direction to be overlapped on said supporting member.

3. The automatic original cover closer according to claim 1, wherein said hinge portions comprising:

a lifting member having a top plate fixed to said original cover and two side plates extending downward from both end portions of the top plate in the orthogonal direction to the top plate respectively;

a fixing pin attached between said both side plates of said mounting member; an actuating pin attached between said both side plates of said supporting member; a first slider slidable fitted into said supporting member and abuts against said fixing pin;

a second slider slidable fitted into said supporting member and abuts against said actuating pin; and a compression coil spring is accommodated between said first slider and second slider.

4. The automatic original cover closer according to claim 1, wherein said hinge portions comprising:

a lifting member having a top plate fixed to said original cover and two side plates extending downward from both end portions of the top plate in the orthogonal direction to the top plate respectively;

a fixing pin attached between said both side plates of said mounting member;

an actuating pin attached between said both side plates of said supporting member;

a first slider slidable fitted into said supporting member and abutted against said fixing pin;

a second slider slidable fitted into said supporting member and abutted against said actuating pin;

a compression coil spring is accommodated between said first slider and second slider; and a fluid damper device installed inside the above-mentioned compression coil spring so as to reduces a rotation speed of said original cover exclusively at a predetermined closing angle or less of the original cover in its rotation in a closing direction.

5. The automatic original cover closer according to claim 1, wherein said side plates of said bottom plate of said mounting member is equipped with respective shaft holes;

wherein said side plates of said to plate of said supporting member is equipped with respective shaft fixing holes to be engaged with said rotation shaft; and wherein said shaft engaging members are a pair of shaft engaging members independently inserted and fixed into the respective shaft fixing holes of both the side plates of said supporting member, and engaging holes are provided on the respective shaft engaging members through which said rotation shaft is inserted without rotating.

6. The automatic original cover closer according to claim 1, wherein said shaft engaging member is a shaft enclosing member in a cylindrical shape and said rotation shaft is attached thereto so as to rotate together with the shaft enclosing member.

7. The automatic original cover closer according to claim 6, wherein said shaft enclosing member is engaged with both the side plates of said supporting member, so as to rotate together with the supporting member.

8. An office equipment comprising an automatic original cover closer according to claim 1.

* * * * *